US006223901B1

(12) United States Patent
Lofgren et al.

(10) Patent No.: US 6,223,901 B1
(45) Date of Patent: May 1, 2001

(54) SUSPENSION PACKAGE

(75) Inventors: Lewis C. Lofgren; Fred Vega; Priscilla M. Keach, all of Chicago, IL (US)

(73) Assignee: ADE, Inc., Chicago, IL (US)

( * ) Notice: Subject to any disclaimer, the term of this patent is extended or adjusted under 35 U.S.C. 154(b) by 0 days.

(21) Appl. No.: 09/500,159

(22) Filed: Feb. 8, 2000

(51) Int. Cl.[7] ..... B69D 81/02
(52) U.S. Cl. ..... 206/583; 206/524.9; 206/495
(58) Field of Search ..... 206/583, 521, 206/594, 495, 497, 524.9

(56) References Cited

U.S. PATENT DOCUMENTS

| | | | |
|---|---|---|---|
| 3,853,220 | 12/1974 | Luray . | |
| 4,491,225 | 1/1985 | Baillod . | |
| 5,056,665 | 10/1991 | Boecker et al. . | |
| 5,226,542 | 7/1993 | Boecker et al. . | |
| 5,323,896 | 6/1994 | Jones . | |
| 5,388,701 | 2/1995 | Ridgeway . | |
| 5,579,917 | 12/1996 | Lofgren et al. . | |
| 5,678,695 | 10/1997 | Ridgeway et al. . | |
| 5,722,541 * | 3/1998 | Lofgren et al. | 206/583 |
| 5,823,348 | 10/1998 | Phillips et al. . | |
| 5,894,932 * | 4/1999 | Harding et al. | 206/583 |

* cited by examiner

*Primary Examiner*—Paul T. Sewell
*Assistant Examiner*—Shian Luong
(74) *Attorney, Agent, or Firm*—Brinks Hofer Gilson & Lione

(57) ABSTRACT

A suspension package includes a platform having a product support surface and first and second end portions on opposite ends of the product support surface. A flexible product retainer sheet has a first part secured to the first end portion and a second part secured to an anchor panel. The product retainer sheet is dimensioned to retain a product on the product support surface when the panel is held against the second end portion, as for example by an outer container or by a releasable attachment.

13 Claims, 3 Drawing Sheets

Fig. 8
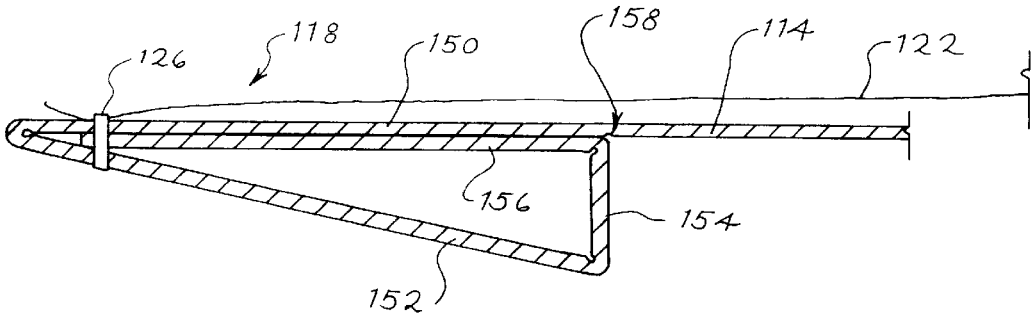
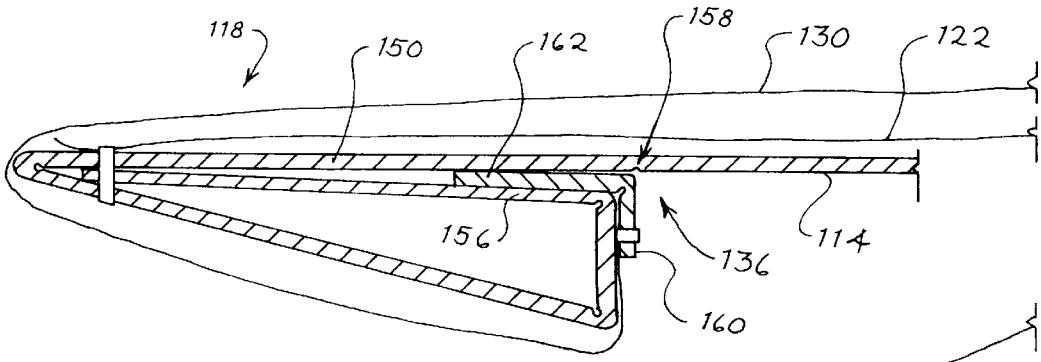
Fig. 9
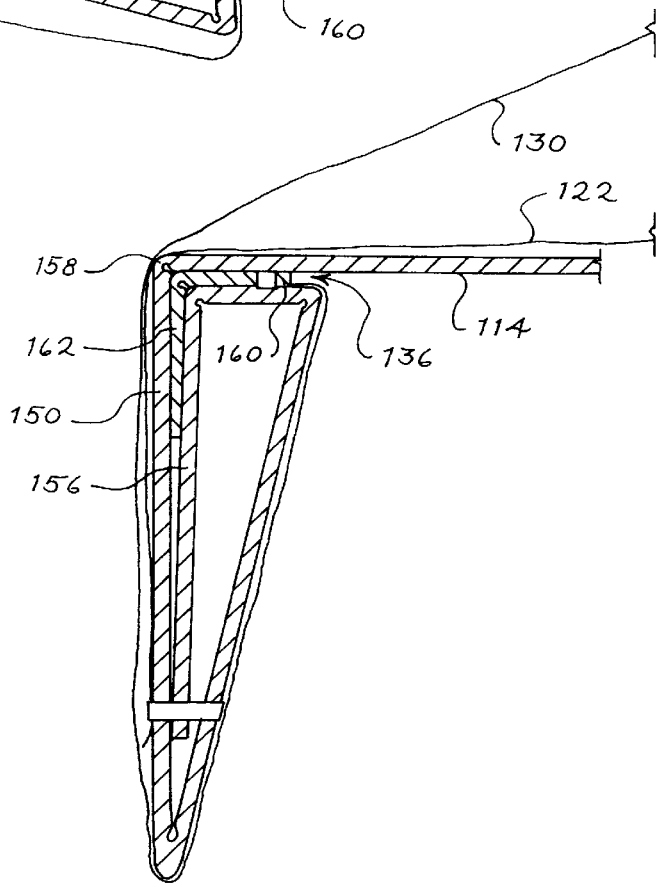
Fig. 10

SUSPENSION PACKAGE

BACKGROUND

The present invention relates to suspension packages, and in particular to suspension packages well suited for use with products having a considerable depth.

Lofgren U.S. Pat. No. 5,579,917, assigned to the assignee of the present invention, discloses one prior-art suspension package that suspends a product in an outer container. In the Lofgren suspension package a hammock is tensioned by panels on opposite ends of a frame, and the product being suspended is held in place by the hammock.

The Lofgren suspension package is well suited for many applications. However, bulky or heavy products may not readily be inserted into the hammock. A need presently exists for an improved suspension package that is well suited for use with bulky or other products having considerable depth or weight.

SUMMARY

The preferred embodiment described below holds a product being packaged on a product support surface of a platform. This is accomplished with a flexible product restrainer sheet that is secured to one end of the platform and that is in turn secured to a panel. In use the panel is inserted between the platform and an outer container to immobilize the product between the product retainer sheet and the product support surface. Alternately, the panel is secured in place near the other end of the platform.

This description of the preferred embodiment has been provided only by way of introduction, and it is not intended to serve as a definition of the invention.

BRIEF DESCRIPTION OF THE DRAWINGS

FIGS. 8–10 are three fragmentary, cross-sectional views of a portion of the suspension package of FIG. 5 at three successive stages of use.

DETAILED DESCRIPTION OF THE PRESENTLY PREFERRED EMBODIMENTS

Figure 1:
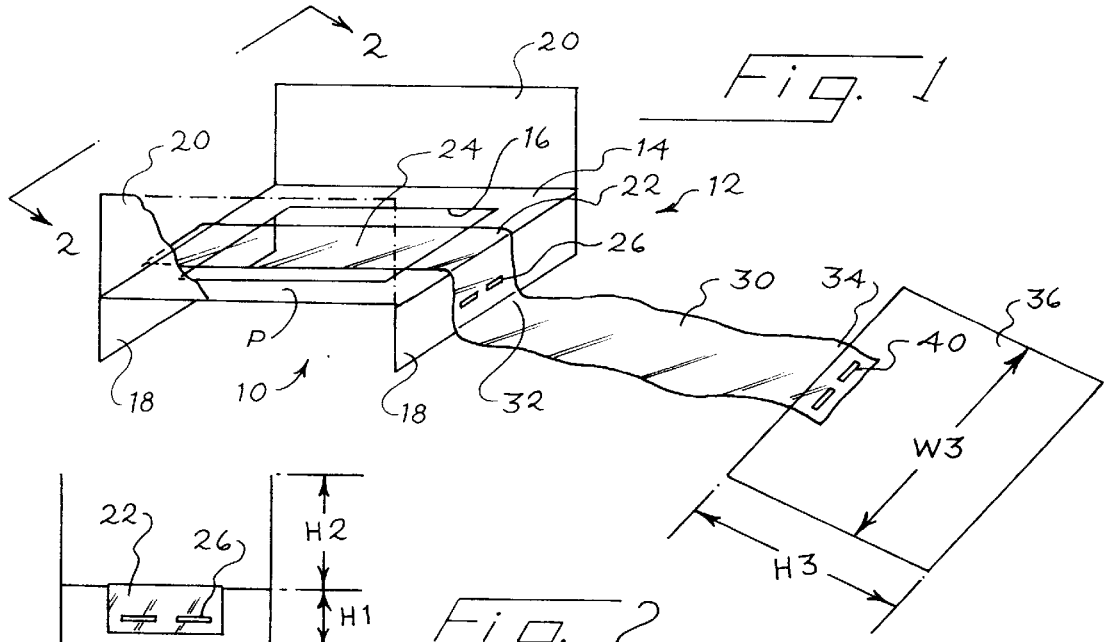
FIG. 1 is a perspective view of a suspension package that incorporates a preferred embodiment of this invention.
Figure 2:
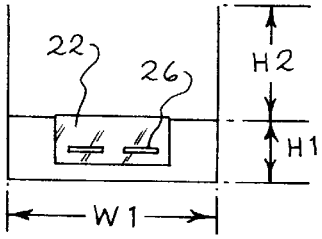
FIG. 2 is an end view taken along line 2—2 of FIG. 1.

Turning now to the drawings, FIG. 1 shows a perspective view of a suspension package 10 that incorporates a preferred embodiment of this invention. The suspension package 10 includes a platform 12 that in this embodiment includes a frame 14 that defines a central opening 16. Two end panels 18 extend downwardly from opposite ends of the frame 14 and two side panels 20 extend upwardly from opposed sides of the frame 14. The end panels 18 each define a width W1 and a height H1, and the side panels 20 define a height H2 (FIG. 2). The front side panel 20 of FIG. 1 is broken away for clarity of illustration; in practice both side panels 20 are preferably identical in shape. In this embodiment, the end panels 18 and the side panels can fold parallel to the frame 14 for compact storage and shipment prior to use.

A flexible sheet 22 is secured to the end panels 18, as for example by staples 26, to extend across the opening 16 in a plane P defined by the frame 14. FIGS. 1 and 2 show the position in the staples 26 on the end panels 18. The flexible sheet 22 forms a product support surface 24 that is initially aligned with the plane P. The suspension package 10 also includes a product retention sheet 30 that in this example is integrally formed with the flexible sheet 22 such that the sheets 22, 30 are two portions of a common element. The product retention sheet 30 includes a first part 32 that is secured to the first end panel 18 and a second part 34 that is secured to an anchor panel 36, as for example with staples 40. The anchor panel 36 defines a width W3 that is approximately equal to the width W1 and a height H3 that is substantially greater than the height H1. In this embodiment the height H3 is equal to the height H1 of the end panels 18 plus the height H2 of the side panels 20.

Figure 3:
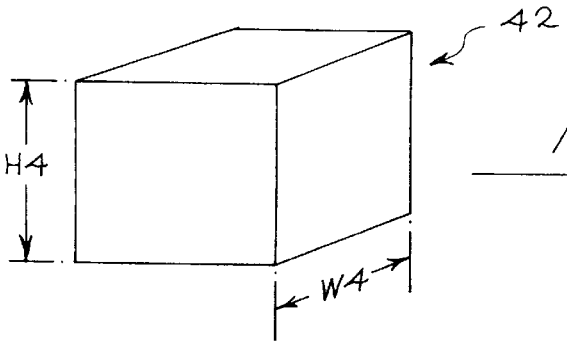
FIG. 3 is a perspective view of an outer container suitable for use with the embodiment of FIG. 1.

FIG. 3 shows an outer container 42 suitable for use with the suspension package 10. The outer container 42 can be a conventional cardboard container that is cubical or prismatic in shape. In this embodiment the width W4 of the outer container 42 (as measured at the interior of the outer container 42) is only slightly greater than the widths W1 and W3 discussed above. The height H4 of the outer container (again as measured at the interior of the outer container 42) in this embodiment is only slightly greater than the height H3 of the anchor panel 36.

Figure 4:
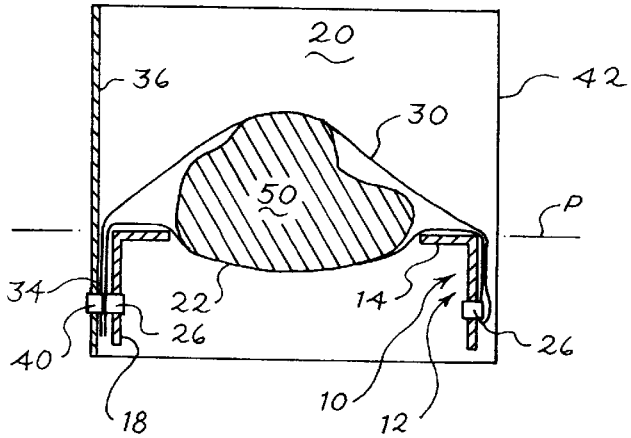
FIG. 4 is a cross sectional view showing the suspension package of FIG. 1 positioned in the outer container of FIG. 3.

FIG. 4 shows a cross-sectional view of the suspension package 10 positioned within the outer container 42. A product 50 has been placed on the flexible sheet 22, and then the sheet 30 has been draped over the product 50 and the anchor panel 36 has been pushed into the region between the outer container 42 and the adjacent end panel 18. Note that the second part 34 is positioned beneath the plane P defined by the frame 14 and the product support surface 24 in its untensioned state.

The length of the product retention sheet 30 has been selected such that the sheet 30 and the sheet 22 are placed under tension to secure the product 50 in place between the sheets 22, 30. The outer container 42 substantially immobilizes the anchor panel 36 with respect to the platform 12, thereby holding the sheet 30 in tension. Note that the anchor panel 36 is immobilized by the outer container 42, because the anchor panel 36 substantially matches the shape of one of the side walls of the outer container 42. Similarly, the platform 12 is immobilized in the outer container 42, because the width W1 matches the width W4 and the combined height of the end panels 18 and the sides panels 20 (H1+H3) matches the height H4.

It should be apparent that the preferred embodiment described above provides the advantage of suspending the product being packaged within the outer container. The product can easily be packaged simply by placing it on the product support surface after the platform has been placed in the outer container. Then the product retainer sheet is stretched over the product and the anchor panel is pushed into the region between the platform and the outer container. The outer container can then be closed to immobilize both the platform and the anchor panel, thereby completing packaging of the product.

The suspension package 10 can be modified as appropriate for particular applications. For example, the length of the product retention sheet 30 can be adjusted as appropriate for the shape and size of the particular product being packaged. A wide range of materials can be used for the platform 14, the sheet 30 and the panel 36. For example, the platform 12 and the panel 36 can be formed of cardboard, and a flexible, stretchable polymer can be used for the sheet 36, such as polyurethane film. Sizes, shapes and proportions can all be modified as appropriate for the particular application. For example the platform may be modified to use other structures that space the frame 14 away from the top and bottom walls of the outer container. Braces such as those described in U.S. patent application Ser. No. 09/036,224, assigned to the assignee of the present invention, can be used, and frames similar to those described in U.S. Pat. No. 5,579,917, also assigned to the assignee of the present invention, can also be adapted for use with this invention.

Many modifications are possible to the preferred embodiment described above. For example, the product support surface 24 is not necessarily formed of a flexible polymer sheet. Rather, the surface 24 may be formed by a continuation of the frame 14, in which case the opening 16 can be eliminated. Openings, slits or other modifications can be made to the support surface 24 to accommodate the particular product being packaged. The end portions that secure the opposite ends of the sheet 22 do not have to define panels as in the preferred embodiment. Rather, the end portions may simply be end portions of the frame 14, which may be substantially confined to a single plane. In this case other structures such as spacers in the outer container (not shown) can be used to space the frame from the top and bottom walls of the outer container.

Other materials can be used, including polymeric or metallic materials for the platform 12. Other securing means such as adhesives can be used in place of the illustrated staples. Other shapes can be used for the anchor panel 36, including shapes that differ from that of the side wall of the outer container.

FIGS. 5–10 relate to a second preferred embodiment that is in many ways similar to the first embodiment described above. In general, corresponding elements of the two embodiments are provided with reference numerals that are identical in the last two digits.

The suspension package 110 includes a platform 112 that in this embodiment includes a rectangular frame 114 that defines a central opening 116. End panels 118 are mounted to respective ends of the frame 114 to fold about respective fold lines 158, and side panels 120 are mounted to respective sides of the frame 114 to fold about respective fold lines.

A flexible sheet 122 is secured between the two end panels 118 to form a product support surface 124 over the region of the central opening 116. In this embodiment staples 126 are used to secure the flexible sheet 122 to the end panels 118.

The suspension package 110 also includes a product retention sheet 130 that in this embodiment is formed as a continuation of the flexible sheet 122. In alternate embodiments separate sheets can be used. The product retention sheet 130 defines a first part 132 near the adjacent end panel 118, and a second part 138 near an anchor panel 136. The product retention sheet 130 is secured to the anchor panel 136 by staples 140 in the region of the second part 134.

The following discussion will concentrate on two primary differences between the packages 110 and 10. These differences relate to the end panels 118 and the anchor panel 136.

Figure 5:
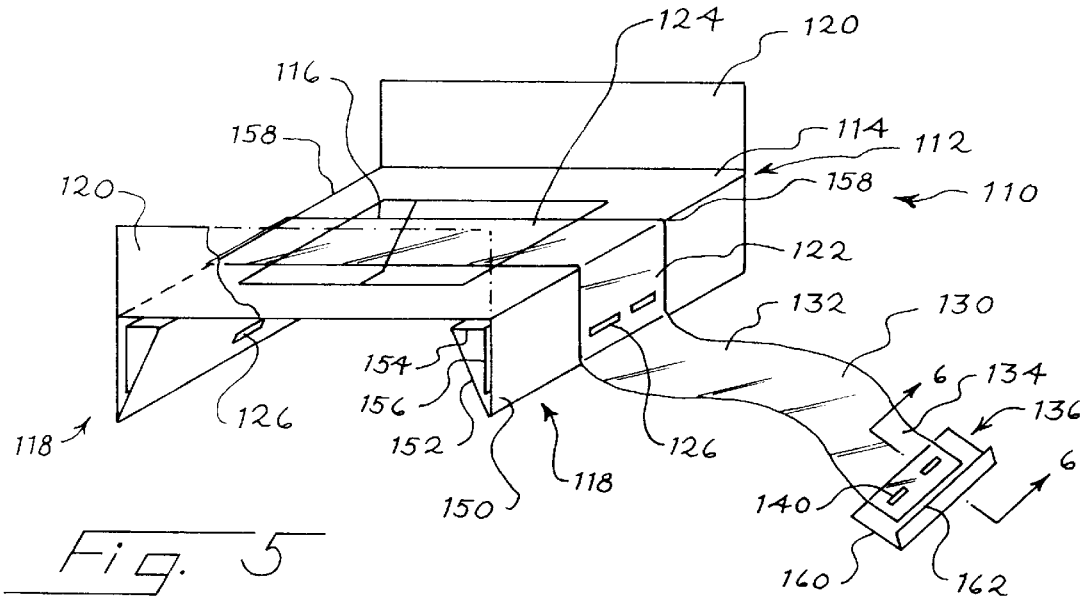
FIG. 5 is a perspective view of a suspension package that incorporates a second preferred embodiment of this invention.

As best shown in FIGS. 5 and 8, both the end panels 118 are shaped as triangular, tubular beams folded from four separate panels. The first panel 150 is secured to the frame 114 at a fold line 158, and at another fold line to a second panel 152. A third panel 154 is secured to the second panel 152 at a fold line, and a fourth panel 156 is secured to the third panel 154 at another fold line. The staples 126 pass through the first, second and fourth panels, and the flexible sheet 122, as shown in FIG. 8. In this way, a rigid, triangular beam is formed. This triangular beam can be rotated to various positions with respect to the frame 114 by pivoting the end panel 118 about the fold line 158.

Figure 6:
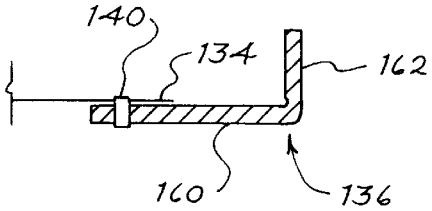
FIG. 6 is a fragmentary sectional view taken along line 6—6 of FIG. 5.

The anchor panel 136 in this embodiment includes first and second panels 160, 162 that are oriented substantially at right angles with respect to one another, as best shown in FIG. 6.

Figure 7:
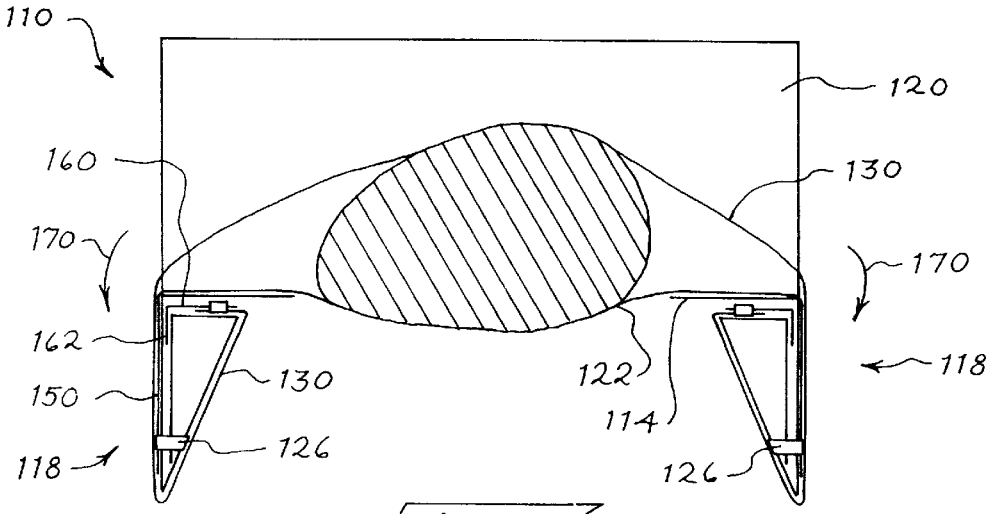
FIG. 7 is a cross sectional view of the suspension package of FIG. 5 with a packaged object secured in place.

FIG. 7 shows the package 110 after a product has been installed in place. Note that the product rests on the flexible sheet 122, and that the product retention sheet 130 is draped over the top of the product. This product retention sheet 130 is secured at the right end (as shown in FIG. 7) by the staples 126. At the left hand (as shown in FIG. 7) the product retention sheet 130 wraps partially around the end panel 118, and the second panel 162 of the anchor panel 136 is fit between the panels 150,156. Rotation of the end panels 118 with respect to the frame 114 in the direction of the arrows 170 increases tension on the product retention sheet 130, thereby securing the packaged product in place between the sheets 122, 130.

The package 110 is originally configured as shown in FIG. 5. At this stage, one or both of the end panels 118 can be rotated such that the panel 150 is coplanar with the frame 114, as shown in FIG. 8.

Then the product being packaged is placed on the product support surface 124, and the product retention sheet 130 is draped over the product around the left hand end panel 118 to the position shown in FIG. 9. Note that the panel 162 of the anchor panel 136 is inserted between the panels 150, 156 of the end panel 118. Once the anchor panel 136 has been installed in place, the end panels 118 are then rotated about the fold lines 158 to the configuration shown in FIG. 10. In this configuration the anchor panel 136 is securely prevented from slipping out of position, and the product retention sheet 130 is tensioned.

In contrast to the package 10 described above, the package 110 is most easily used by first loading the product into the package 110 as described above, before the package 110 is inserted into a shipping container (not shown).

Of course, many modifications are possible to the package 110 described above, including the modifications suggested above in conjunction with the package 10. In addition, any suitable attaching mechanism can be used to secure the anchor panel 136 in place to the end panel or the frame 114, including a wide variety of adhesives, fasteners, and mechanical interlocking arrangements. If desired, the product 50 may be enclosed in a protective layer or structure before it is placed on the flexible sheet 22. For example, bubble pack or even a suspension package can be used to provide another layer of protection for an extremely fragile product.

The foregoing detailed description has described only a few of the many forms that this invention can take. For this reason this detailed description is intended by way of illustration and not by way of limitation. It is only the following claims, including all equivalents, that are intended to define the scope of this invention.

What is claimed is:

1. A suspension package comprising:

a platform comprising a product support surface and first and second end portions disposed on respective opposed ends of the product support surface;

a flexible product retainer sheet comprising a first part secured to the first end portion and a second part;

a panel secured to the second part, said panel freely movable with respect to the platform within a range of movement determined by the sheet;

a product supported on the product support surface;

said sheet dimensioned to press against an upper surface of the product and to hold the product against the product support surface when the panel is held adjacent the second end portion.

2. The suspension package of claim 1 wherein the panel comprises a hook shaped to releasably attach to the second end portion.

3. The suspension package of claim 1 further comprising:

means for releasably attaching the panel to the second end portion.

4. The suspension package of claim 1 wherein the panel is L-shaped in cross section.

5. The suspension package of claim 1 wherein each end portion comprises a respective end panel.

6. The suspension package of claim 5 wherein each end panel is pivotably secured with respect to a central portion of the platform to pivot about a respective line.

7. The suspension package of claim 5 wherein each end panel comprises a respective tubular beam.

8. A suspension package comprising:

a platform comprising a product support surface and first and second end portions disposed on respective opposed ends of the product support surface;

a flexible product retainer sheet comprising a first part secured to the first end portion and a second part;

a panel secured to the second part, said panel freely movable with respect to the platform within a range of movement determined by the sheet;

said sheet dimensioned to retain a product on the product support surface when the panel is held adjacent the second end portion;

wherein the second end portion defines a first width along the support surface and a first height transverse to the support surface, and wherein the panel defines a second width substantially equal to the first width and a second height greater than the first height.

9. A suspension package comprising:

a platform comprising a product support surface and first and second end portions disposed on respective opposed ends of the product support surface;

a flexible product retainer sheet comprising a first part secured to the first end portion and a second part;

a panel secured to the second part, said panel freely movable with respect to the platform within a range of movement determined by the sheet;

said sheet dimensioned to retain a product on the product support surface when the panel is held adjacent the second end portion;

an outer container, said platform positioned in the outer container, said panel positioned between the outer container and the second end portion of the platform.

10. The suspension package of claim 9 wherein the sheet extends over the product support surface and the second part is positioned under a plane defined by the product support surface.

11. The suspension package of claim 10 wherein the outer container engages the panel, thereby preventing the sheet from moving in a direction that would allow the second part to approach the plane.

12. A suspension package comprising:

a platform comprising a product support surface and first and second end portions disposed on respective opposed ends of the product support surface;

a flexible product retainer sheet comprising a first part secured to the first end portion and a second part;

a panel secured to the second part, said panel freely movable with respect to the platform within a range of movement determined by the sheet;

said sheet dimensioned to retain a product on the product support surface when the panel is held adjacent the second end portion;

wherein the platform comprises a frame that forms an opening and a second flexible sheet secured to the first and second end portions and extending over the opening to form the product support surface.

13. The suspension package of claim 12 wherein the first-mentioned product retainer sheet and the second sheet are integrally formed from a common element.

* * * * *